US007121167B1

(12) United States Patent
Miner

(10) Patent No.: US 7,121,167 B1
(45) Date of Patent: Oct. 17, 2006

(54) FLAT HEAD REVERSIBLE POWER RATCHETS

(76) Inventor: Montie H. Miner, 3413 Maryville Rd, Granite City, IL (US) 62040

( * ) Notice: Subject to any disclaimer, the term of this patent is extended or adjusted under 35 U.S.C. 154(b) by 0 days.

(21) Appl. No.: 11/091,645

(22) Filed: Mar. 29, 2005

(51) Int. Cl.
*B25B 13/46* (2006.01)
*B25B 17/00* (2006.01)

(52) U.S. Cl. ..... 81/57.39; 81/61; 81/62; 81/63.1

(58) Field of Classification Search ..... 81/57.39, 81/61, 62, 63.1
See application file for complete search history.

(56) References Cited

U.S. PATENT DOCUMENTS 5,000,066 A * 3/1991 Gentiluomo ..... 81/62
5,450,773 A * 9/1995 Darrah et al. ..... 81/57.39
5,537,899 A 7/1996 Diedrich
5,622,089 A * 4/1997 Gifford, Sr. ..... 81/62
6,282,990 B1 9/2001 Miner
6,330,842 B1 12/2001 Brun
6,640,669 B1 11/2003 Izumisawa

* cited by examiner

*Primary Examiner*—Lee D. Wilson
*Assistant Examiner*—Shantese McDonald

(57) ABSTRACT

A flat headed, reversible power ratchet of relatively small size which uses integral bosses and apertures in its housing to locate and control the movement of its yoke and driving gears on bosses integral to the housing with the driving gear mounted in a bore within the yoke, which has its pawls and pawl controls within the yoke adjacent the gear, and by utilizing a pair of linkages which pivot about the yoke and about the housing in overlapping arcs to stabilize the position of the directional controls during operations.

10 Claims, 8 Drawing Sheets

FLAT HEAD REVERSIBLE POWER RATCHETS

This invention relates to pneumatically operated ratchet tools.

BACKGROUND

There is a need for a low profile, compact, power ratchet tool adapted for use in small areas where the conventionally sized ratchets cannot provide ready access. U.S. Pat. No. 6,282,990 was issued to me for such a ratchet. My present invention represents a substantial improvement over the former in that it is more compact, has higher reversing reliability, fewer parts, greater efficiency, and is provided with a positive latching reversing control.

It is the object of this invention to provide a low profile flat head ratchet which is more compact, has higher reversing reliability in that the reversing directional controls lock into place, and has greater efficiency,

IN THE DRAWINGS

DESCRIPTION

Figure 1:
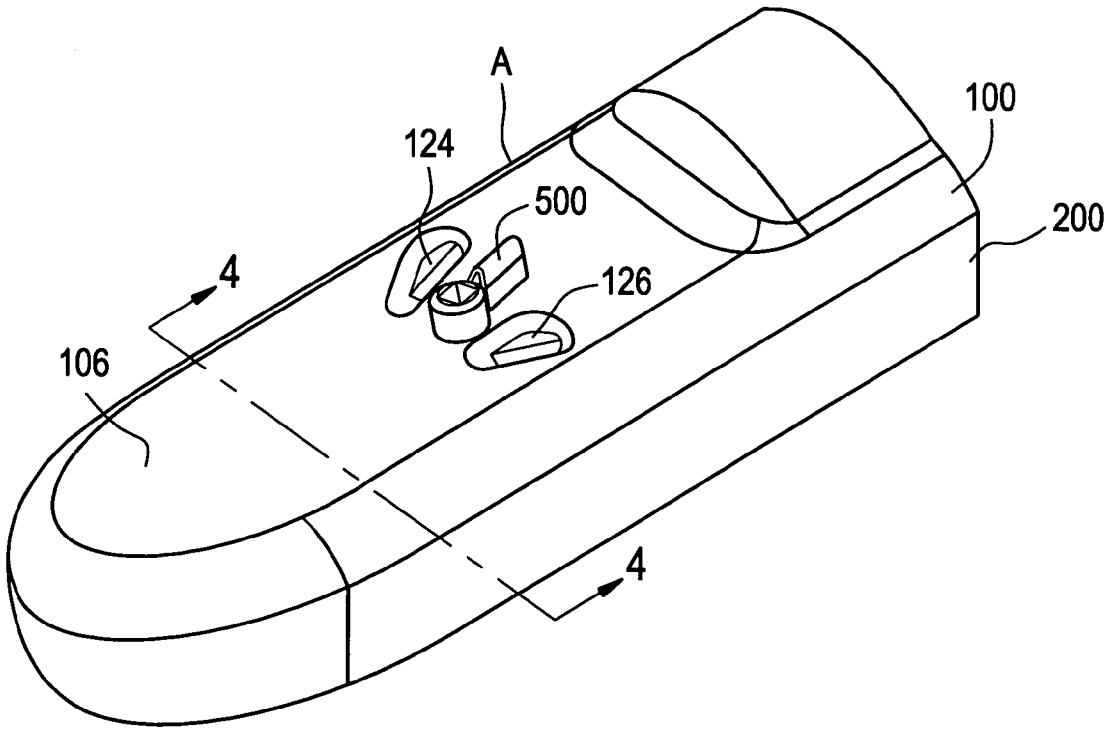
FIG. 1 is a perspective view of a preferred embodiment of my invention.
Figure 2:
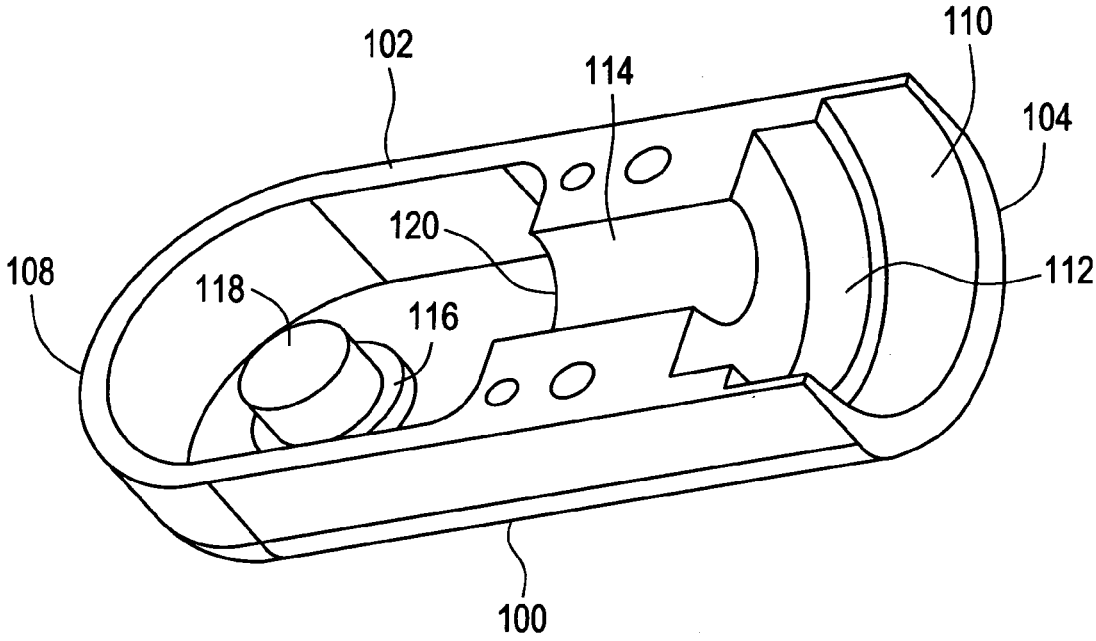
FIG. 2 is a perspective view of the interior of the upper housing.
Figure 3:
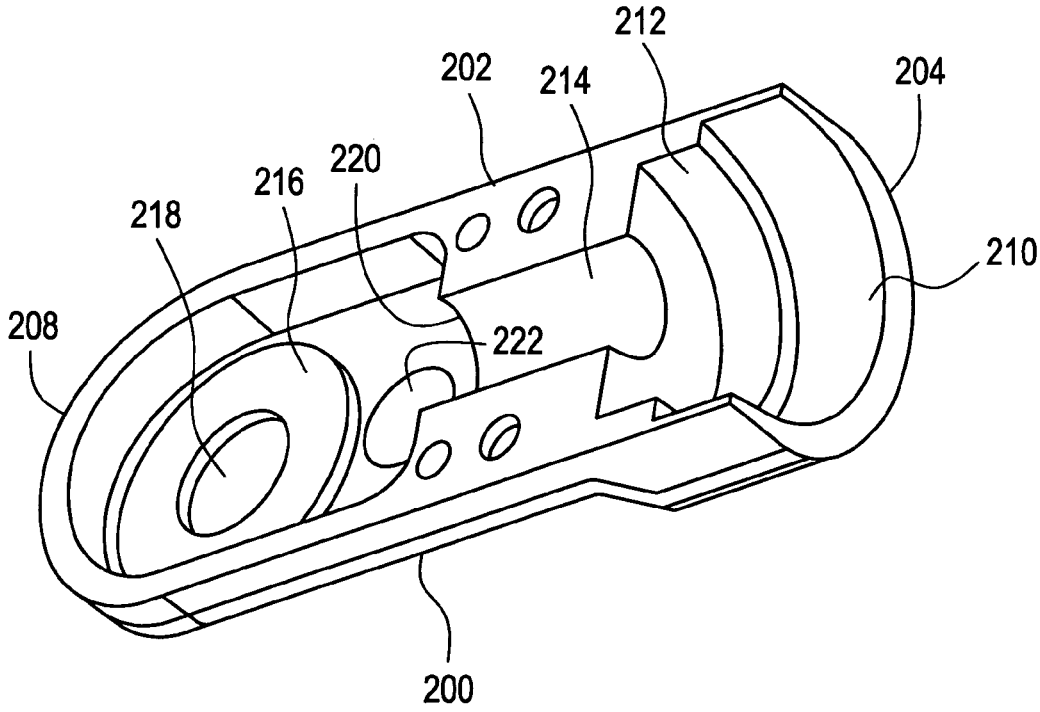
FIG. 3 is a perspective view of the interior of the lower housing
Figure 4:
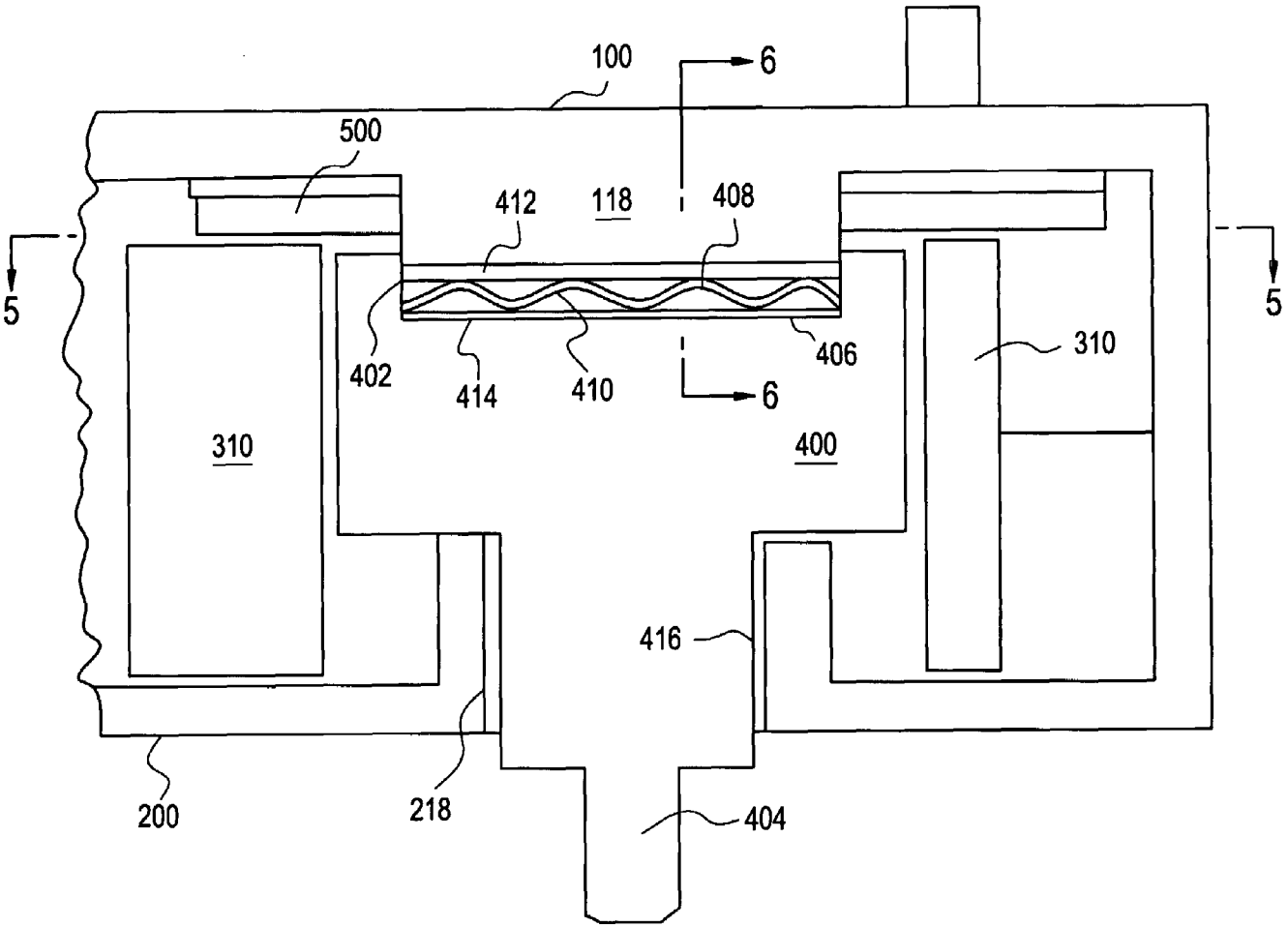
FIG. 4 is an enlarged sectional view taken along lines 4—4 of FIG. 1.
Figure 5:
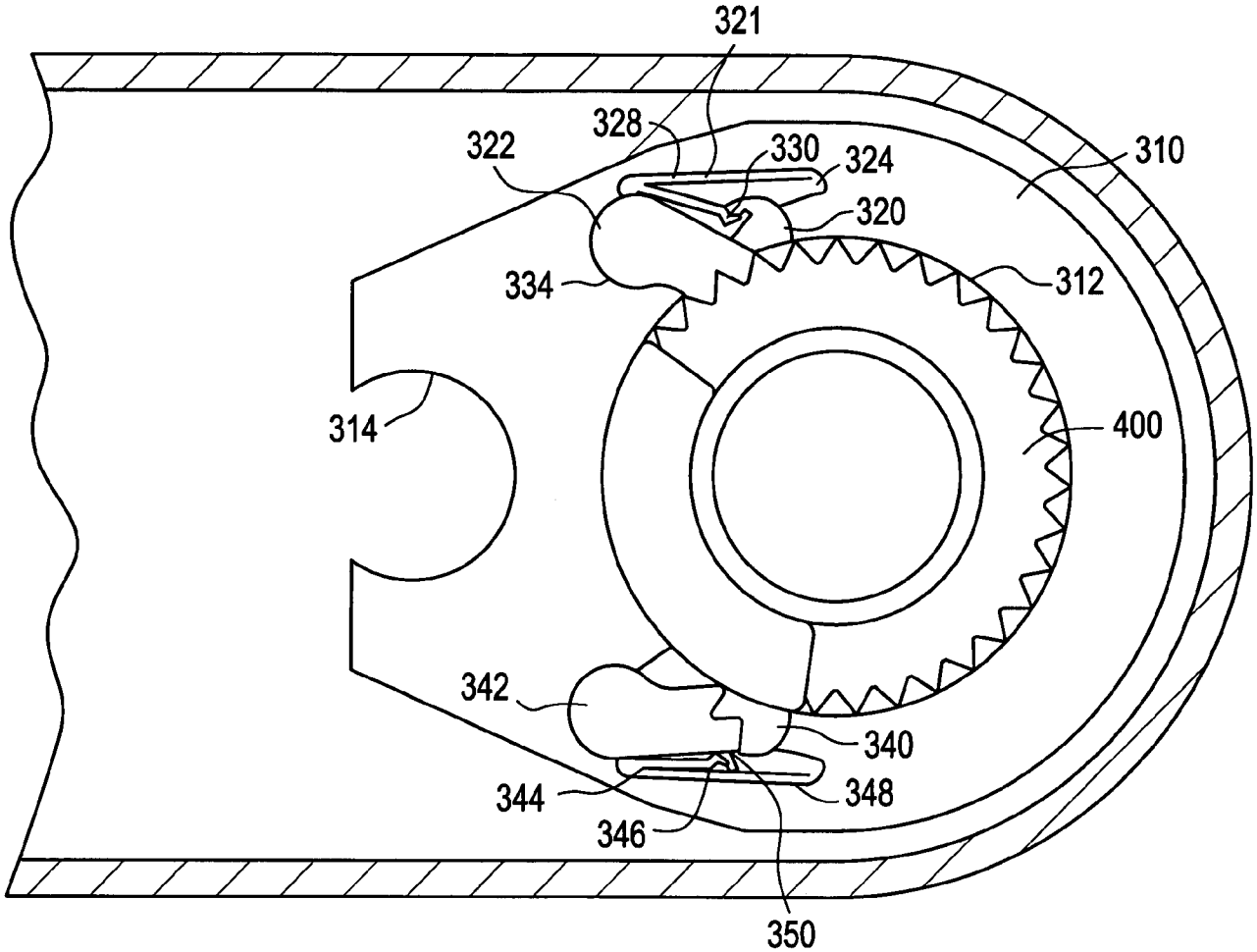
FIG. 5 is a fragmentary sectional view taken along lines 5—5 of FIG. 4.
Figure 6:
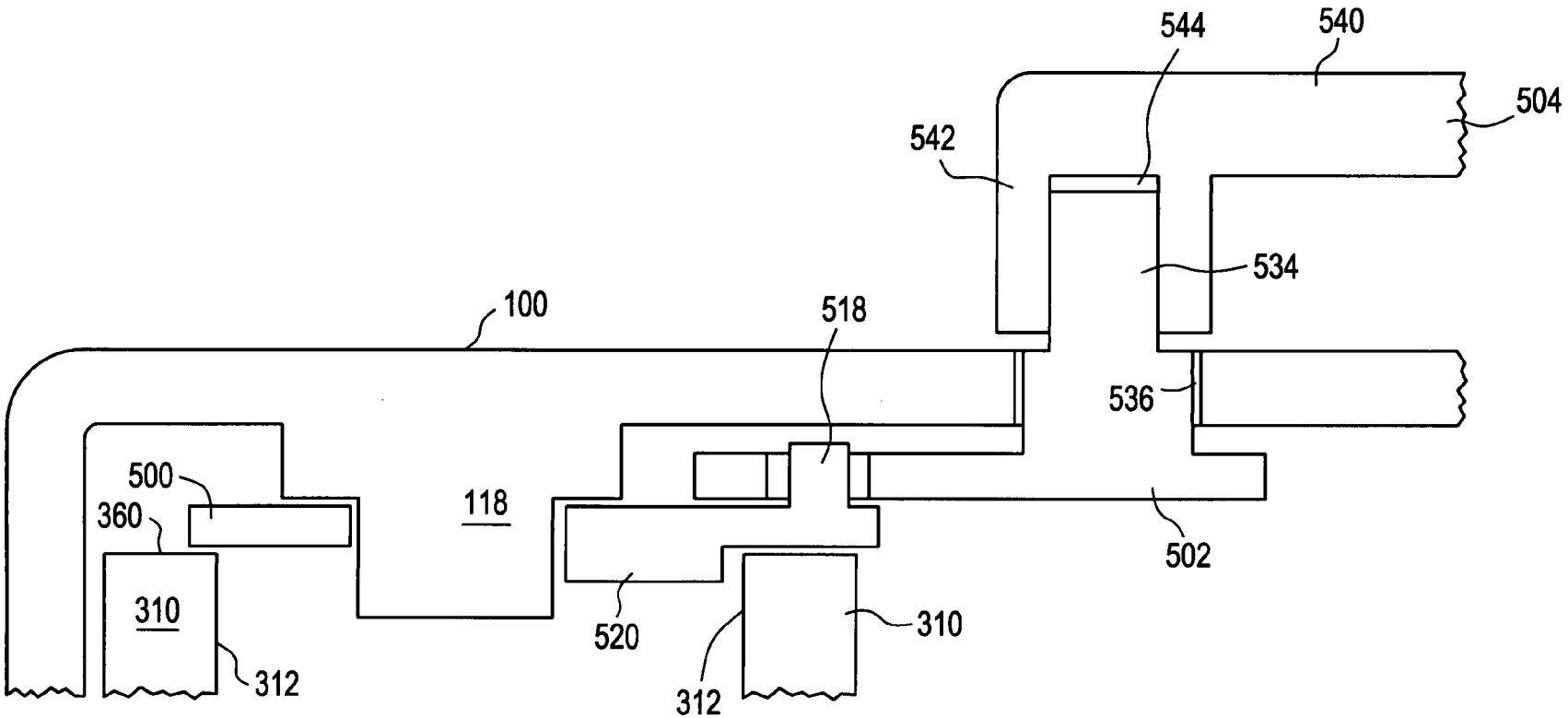
FIG. 6 is a fragmentary sectional view taken along lines 6—6 of FIG. 4.
Figure 8:
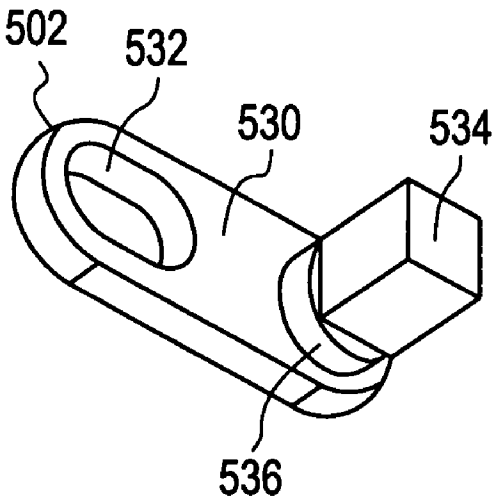
FIG. 8 is an top perspective view of my reverser link.
Figure 7:
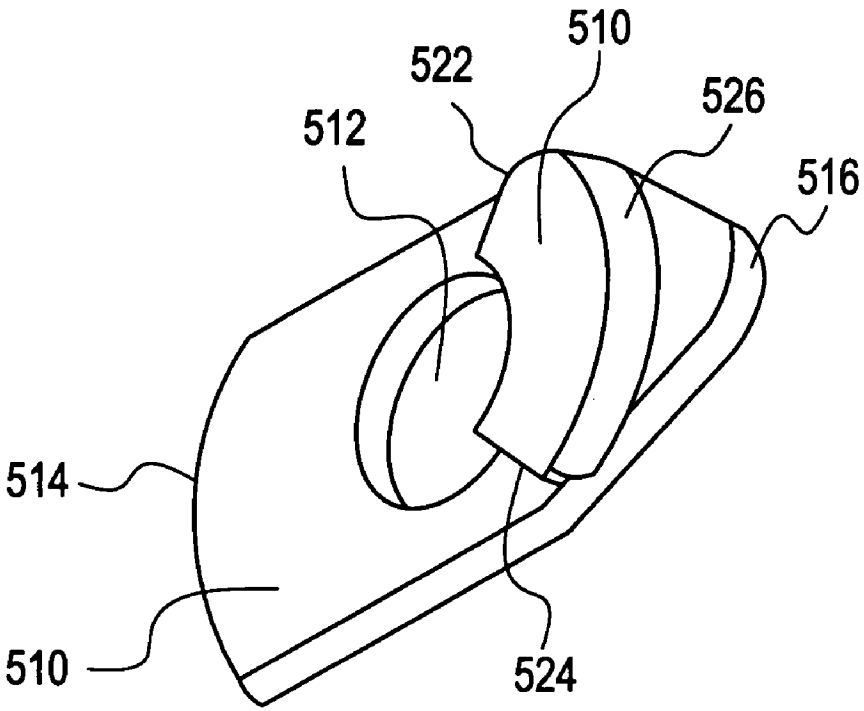
FIG. 7 is an bottom perspective view of my reverser.

Referring now in more detail by reference character to the drawings, which illustrate a preferred embodiment of my invention, A designates a reversible power ratchet having an upper housing 100 comprising an elongated shell 102 having an enlarged end 104, an elongated flat top 106, and an annular wall 108 at its other end. The enlarged end 104 is provided with three concentric annular sections 110, 112, 114 extending inwardly from the end 108 to the center of the housing 100, the section 110 being the largest in radius and the section 114 being the smallest in radius. Provided on the inner wall of the flat top 106 near the end 108 are two downwardly extending, concentric, annular bosses 116, 118, the boss 118 being closer to the top 102 and being larger in radius than the boss 116. It should be here noted that there is substantial separation between the boss 118 and the inner wall 120 defined by the end of the section 114 for purposes presently more fully to appear. Centrally located on the top 106 is a bore 122 and located on the outer portion of the top 106 are two upwardly projecting stops 124, 126.

The lower housing 200 similarly comprises an elongated shell 202 which is provided with an enlarged end 204, an elongated flat bottom 206, and an annular wall 208 at its other end. The enlarged end 204 is provided with three concentric annular sections 210, 212, 214 extending inwardly from the end 208 to the center of the housing 200, the section 210 being the largest in radius and the section 214 being the smallest in radius. Provided on the inner wall of the flat bottom 206 near the end 208 is an upwardly extending annular boss 216 provided with a concentric bore 218 which extends through the boss 216 and the bottom 206. It should be here noted that there is also substantial separation between the boss 216 and the inner wall 220 defined by the end of the section 214 for purposes presently more fully to appear. Centrally located on the bottom 202 between the boss 216 and the wall 220 is an outwardly projecting clearance dimple 222.

The two housings 100, 200, are sized and shaped for engaged attachment to each other in such manner that (a) the sections 110, 210, define a smooth cylindrical threaded means for attaching the tool A to a conventional pneumatic motor (not shown), (b) the sections 114, 214, define a cylindrical passageway for a bell crank C to be driven;

(c) the bosses 116, 118, 216, and the bore 218 are all coaxial; and (d) the walls 120, 220, are in alignment and define a chamber D within the combined housings 100, 200.

Figure 9:
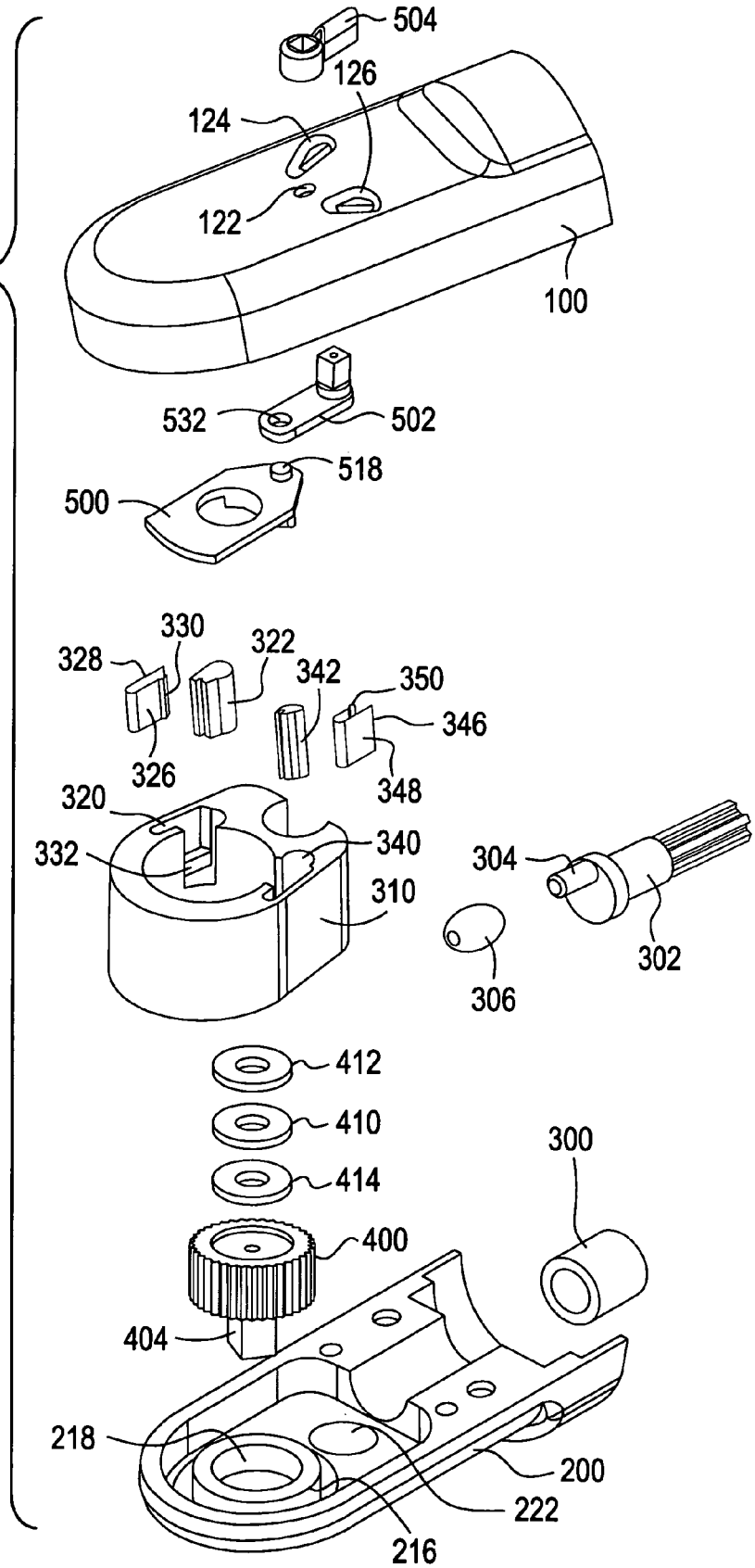
FIG. 9 is an exploded view of my invention.
Figure 10:
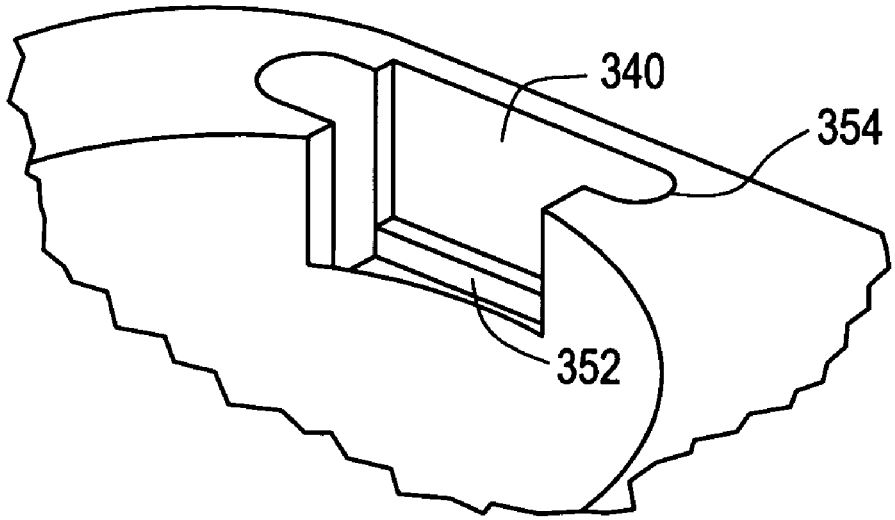
FIG. 10 is an enlarged view of my pawl chamber 340.

Referring in detail to FIG. 9, mounted in the combined housings 100, 200 in the space defined by the sections 114, 214, is a bearing 300, in which is rotatably disposed a bell crank 302 provided at its driven end 304 with a bell crank ball 306. Disposed in the space between the bell crank ball 304 and the bosses 116, 118, 216, in the combined housings 100, 200, is a yoke 310 having a bore 312 sized for pivotal disposition about the boss 118.

The end 314 of the yoke 310 away from the boss 118 is U-shaped and sized for accepting the bell crank ball 304 so that the yoke 310 will be pivoted back and forth about the boss 118 in the conventional manner as the bell crank 302 is rotatably driven. On opposing sides of the bore 312, the yoke 302 is provided with a pair of complementary pawl chambers 320, 340 each respectively adapted to house a pawl 322, 342. Immediately adjacent to and in communication with the pawl chamber 320 is a spring chamber 324 in which is disposed a U-shaped spring 326 having a flat face 328 which is seated in spring chamber 324 and a V-shaped other face 330 which presents an outwardly directed bias to the pawl 322, urging the pawl 322 into the bore 312. Similarly, immediately adjacent to and in communication with the pawl chamber 340 is a spring chamber 344 in which is disposed a U-shaped spring 346 having a flat face 348 which is seated in spring chamber 344 and a V-shaped other face 350 which projects into the pawl chamber 340.

The pawl chamber 320 is slightly deeper in depth than the spring chamber 324 and is provided with a short wall section 332 where it intersects the spring chamber 324. The pawl chamber 320 is also provided with an arcuate end 334, the arc of which is substantially greater than 180 degrees, and at its other end opens into the bore 312, all for purposes presently more fully to appear. Similarly, the pawl chamber 340 is slightly deeper in depth than the spring chamber 344 and is provided with a short wall section 352 where it intersects the spring chamber 344. The spring chamber 340 is also provided with an arcuate end 354, the arc of which is substantially greater than 180 degrees, and at its other end opens into the bore 312, all for purposes presently more fully to appear. The spring chambers 324, 344, and the pawl chambers 320, 340, each extend downwardly from the top 360 of the yoke 312.

Rotatably disposed in the bore 312 is a drive gear 400 provided at its end near the boss 118 with an axially extending annular recess 402 and at its other end with a square socket attachment post 404 which extends through the bore 218 for conventional attachment of sockets (not shown). Disposed between the end of the boss 118 and the base 406 of the recess 402 is a washer sandwich 408 comprising a wave washer 410 disposed between an upper friction washer 412 and a lower friction washer 414. The drive gear 400 also includes a diametrically reduced intermediate segment 416 which is sized for close fitting but freely movable disposition in the bore 218. It should be here noted that the gear 400 is provided with gear teeth constructed at angles which will enable efficient engagement with the pawls 322, 342, (similar to the teeth on the gear described in U.S. Pat. No. 5,738,192 issued to me on Apr. 14, 1998 for Power Tool Drives), and similarly the teeth on each of my pawls 322, 342, are constructed of differing size and height as described in said patent. It should also be here noted that the axial length of the bore in my yoke 312 is longer than the axial length of my drive gear 400 such that the pawls 322, 342, will extend above the upper surface of the yoke 300 as the drive gear 400 is rotated in the bore 312. It should be also noted that the orientation of the pawl chambers 320, 340, and the pawls 322, 342, respectively is similar to the orientation of the pawls and pawl chambers described in U.S. Pat. No. 5,738,192 such that once contact is made between either pawl and the teeth in drive gear 400, the teeth of the pawl will slip into full engagement with the teeth in the drive gear 400 and the pawl will backload itself snugly against the yoke 300, whereby to maximize torque while minimizing friction.

Control of the direction of driven rotation of the drive gear is achieved through a reverser system which includes a reverser 500, a reverser link 502 and a reverser lever 504. The reverser 500 comprises a substantially flat plate 510 having a centrally located bore 512, an arcuate end 514, and an opposing V-shaped end 516 provided with a upwardly extending cylindrical member 518. Near the end 516 and projecting downwardly therefrom is a pawl selector 520 having a pair of flat spaced shoulders 522, 524, disposed within the bore of the yoke 312, near the pawl chambers 320, 340, respectively. The selector 520 extends radially outwardly from the center of the bore 512 and is provided with an annular outer shoulder 526 comprising an annular arc concentric with the bore 512. The bore 512 of the reverser 500 is snugly but movably disposed around the boss 118 between the yoke 310 and the upper housing 100. The reverser 500 is sized so that it will rest on the top 360 of the yoke 312 with the annular member 520 projecting into the bore 312.

The reverser link 502 comprises an elongated element 530 provided at one end with an aperture 532 sized in width for accepting the annular member 518 and in length for allowing linear movement of the member 518 in the aperture. The link 502 is provided at its other end with an upwardly projecting square post 534 and an annular section 536 sized for snug but movable disposition in the bore 122 of the upper housing 100. The reverser lever 504 comprises an arm 540 and a downwardly extending post 542 having a cavity 544 sized for tight disposition about the post 534. The annular member is snugly but slidably disposed in the aperture 532 for purposes presently more fully to appear.

The stops 124, 126, are located on the upper surface of the housing 100 in such position that when the arm 540 of the reverser lever 504 is against the stop 124, the shoulder 526 of the reverser 500 retains the pawl in the pawl chamber while the flat shoulder of the reverser 500 is presented to the other pawl chamber whereby the pawl is allowed access to the drive gear. Similarly, when the arm 540 of the reverser lever 504 is against the stop 126, the shoulder 526 of the reverser 500 retains the pawl in the pawl chamber while the flat shoulder of the reverser 500 is presented to the other pawl chamber whereby the pawl is allowed access to the drive gear. Thus it should be apparent that the position of the reverser lever 504 with respect to the stops 124, 126, controls the direction of driven rotation of the drive gear 400. It should be here noted that the arc is which the annular member 518 moves as it is pivoted about the boss 118 and the arc in which the aperture 532 moves as the lever 504 is pivoted are overlapping arcs which overlap in the center of the pivotal movements whereby to require a slight but positive manual force to move the lever 504 into a selected position.

Operation:

In operation, the operator selects the direction of desired driven rotation and places the reverser arm 504 against the selected stop 124 or 126. It should be here noted that as the post 542 is pivotally moved, the element 530 moves in an arcuate path and causes the plate 510 also to move in an arcuate path. The elliptical bore 532 is sized to permit the element 530 and the plate 510 to move freely without interference, but is sized in width to restrict the movement of the annular member 518 to a linear movement within the bore 532. This restricted movement causes the arm 504 to be held firmly in place snugly in place against the particular stop 124 or 126 against which it is positioned, thereby preventing accidental disengagement of the reverser. By selecting the stop 124, the arcuate member 520 of the reverser 500 will be positioned across the pawl chamber 340 and the pawl 342 will be thereby prevented from engaging the drive gear 400. At that same time, the other end of the member 520 will not impede movement of the pawl 322 into engagement with the drive gear, and as the bell crank C is driven, the pawl 322 will drive the gear 400 in the chosen direction in the conventional manner. Similarly, by selecting the stop 126, the arcuate portion 520 of the reverser 500 will be positioned across the pawl chamber 340 and the pawl 342 will be thereby prevented from engaging the drive gear 400. At that same time, the opposing end of the member will not impede movement of the pawl 322 into engagement with the drive gear 400 as the bell crank C is driven, and the pawl 322 will drive the gear 400 in the opposing direction in the conventional manner. To applicant's knowledge and belief, this is the first positive locking mechanism ever developed for a reversible float head ratchet.

It should also be here noted that each of the springs 326, 346, are sized in length such that spring bias is presented to the respective pawls 322, 342, as they are urged toward engagement with the teeth of the gear 400 and that upon a tooth of the selected pawl engaging a gear tooth, the bias provided by the spring 326, 346, is removed from the respective pawl and the shape of the tooth leads the respective pawl into complete engagement with the gear teeth. This unique and novel feature eliminates most of the wear on the pawl teeth and gear teeth caused by the return stroke of the yoke and greatly enhances the life of the tool. In addition, the individual teeth of the pawl and drive gear 400 become fully nested before driving force is applied causing the application of greater driving force to the drive gear and thereby increasing torque. The combination of the pawls having different sized teeth, and the gear teeth being constructed at the angles as described in my U.S. Pat. No. 5,738,192 together with the removal of spring bias during the major portion of the forward and return strokes of the yoke, greatly increases the life expectancy of the tool by a factor of at least four.

It should be apparent that changes and substitutions in the unique and novel arrangement, combination, assembly and interaction of the various parts and components shown and described herein may be made without departing from the nature and principle of my invention.

Having thus described my invention, what I claim and desire to secure by Letters Patent is shown in the drawings, described in the specification and claimed in the following claims:

1. A reversible ratchet comprising an elongated housing, a gear rotatably mounted in the housing, a yoke pivotally disposed about the gear, means for pivoting the yoke about the gear, first pawl means for driving the gear in one rotational direction as the yoke is pivoted about the gear, second pawl means for driving the gear in the opposite rotational direction as the yoke is pivoted about the gear, and reversing means for selecting which pawl means will be in engagement with the gear, said reversing means including a first link pivotally mounted on the housing and also being disposed on the yoke, a second link pivotally mounted on the housing and being located near the yoke, a lever secured to the second link outside the housing, and interlocking means for connecting the first link and second link to each other whereby to permit the first or second pawl means to selectively drive the gear as the lever is selectively positioned with respect to the housing.

2. A ratchet according to claim 1 in which the first and second pawl means each include biasing means for urging the respective pawl means into engagement with the gear, and the first link includes a plate pivotally disposed in the housing with respect to the yoke and also includes holding means for holding each pawl means away from engagement with the gear while the other pawl means is engaged with the gear, said holding means also including an element which extends downwardly into the yoke and which selectively permits only one biasing means to urge its respective pawl into engagement with the gear.

3. A ratchet according to claim 2 in which the pivoted end of the first link includes an upwardly projecting post which extends through a slot in the pivoted end of the second link, whereby when the lever is moved to its extremity in one direction the first pawl means will be in secured driving engagement with the gear while the second pawl means is precluded from driving engagement with the gear, and as the lever is moved to its other extremity the second pawl means will be in secured driving engagement with the gear in the opposing direction while the first pawl means is precluded from driving engagement with the gear.

4. A ratchet according to claim 3 in which the first link and second link are sized such that the end of the first link and the end of the second link will pivot through overlapping arcs as the lever is moved between the preselected positions, whereby to cause the lever to be substantially free from random movement when positioned.

5. A ratchet according to claim 4 in which the housing is provided with external stops for limiting the movement of the lever and the positioning of the first and second pawl means during operation.

6. In a reversible ratchet which comprises a housing, a yoke pivotally mounted in said housing and provided with a central bore, a gear wheel rotatably disposed in the central bore and provided with a plurality of gear teeth presented toward the yoke, first and second pawls mounted within the yoke on opposing sides of the bore, a reverser comprising first biasing means for urging the first pawl into engagement with the gear wheel, second biasing means for urging the second pawl into engagement with the gear wheel, said reverser comprising a first link pivotally mounted in the housing on top of said yoke and including an upwardly projecting annular element, a second link pivotally mounted in the housing and including an extension provided with a slot in which the element of the first link is movably disposed, said second link also including a post movable disposed in said housing and projecting upwardly therefrom, and a switch lever secured to said post, said first link being provided with directional means for selectively holding the first pawl away from the gear wheel when the lever is positioned to one lateral extreme and conversely for selectively holding the second pawl away from the gear wheel when the lever is positioned to the opposing lateral extreme of movement with respect to the housing.

7. A reverser according to claim 6 in which the pivotal arc of the first link and the pivotal arc of the second link overlap and the slot is sized sufficiently to allow the lever to be pivoted between the two pivotal extremities.

8. A reverser according to claim 7 in which the first link also includes an integral arcuate element which extends downwardly into the bore and which is sized and located for holding the first pawl away from engaging the gear wheel when the lever is positioned at one extremity and for holding the second pawl away from engagement with the gear wheel when the lever is positioned at the other extremity.

9. A reverser according to claim 6 in which the first link also includes an integral arcuate element which extends downwardly into the bore and which is sized and located for allowing the first pawl to be in exclusive engagement with the gear wheel when the lever is positioned at one extremity and allowing the second pawl to be in exclusive engagement with the gear wheel when the lever is positioned at the other extremity.

10. A reversible ratchet which comprising a yoke pivotally mounted in a housing and provided with a central bore, a gear wheel rotatably disposed in the central bore and provided with a plurality of gear teeth, first and second pawls mounted in the yoke, first biasing means for urging the first pawl into engagement with the gear wheel, second biasing means for urging the second pawl into engagement with the gear wheel, a first link pivotally mounted on said yoke, a second link pivotally mounted on the housing, and switching means for simultaneously pivoting the first link with respect to the yoke and the second link with respect to the housing, said switching means including a lever pivotally mounted on the housing and attached to the first link, and pawl selection means for selectively bringing either the first pawl or second pawl into engagement with the gear wheel and retaining the pawl in engagement until the lever is manually pivoted.

* * * * *